US007699416B2

(12) United States Patent
Imai

(10) Patent No.: US 7,699,416 B2
(45) Date of Patent: Apr. 20, 2010

(54) PRINTING DEVICE

(75) Inventor: Masaaki Imai, Kasugai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 160 days.

(21) Appl. No.: 11/692,497

(22) Filed: Mar. 28, 2007

(65) Prior Publication Data

US 2007/0229565 A1 Oct. 4, 2007

(30) Foreign Application Priority Data

Mar. 29, 2006 (JP) ..... 2006-090471

(51) Int. Cl.
*B41J 29/38* (2006.01)

(52) U.S. Cl. ..... 347/5; 347/19; 347/23

(58) Field of Classification Search ..... 347/5, 347/8, 9, 16, 19, 22, 23
See application file for complete search history.

(56) References Cited

U.S. PATENT DOCUMENTS

| | | | | |
|---|---|---|---|---|
| 6,918,646 | B2 * | 7/2005 | Kanda et al. | 347/19 |
| 2005/0052481 | A1 * | 3/2005 | Takahashi et al. | 347/8 |
| 2006/0164448 | A1 * | 7/2006 | Sugiyama et al. | 347/5 |

FOREIGN PATENT DOCUMENTS

| | | |
|---|---|---|
| JP | 6-047921 | 2/1994 |
| JP | 8-323992 | 12/1996 |
| JP | 9-076487 | 3/1997 |
| JP | 2004167911 | 6/2004 |
| JP | 2005-59452 | 3/2005 |

OTHER PUBLICATIONS

Office Action issued in JP Application No. 2006-090471, mailed Nov. 4, 2009.

* cited by examiner

*Primary Examiner*—Lam S Nguyen
(74) *Attorney, Agent, or Firm*—Banner & Witcoff, Ltd.

(57) ABSTRACT

A printing device includes: a conveying unit; a printing unit; a detecting unit; a partial printing unit; a reverse conveying unit; a printing state detecting unit; and a restoration process executing unit. The conveying unit conveys a recording medium in a conveying direction to a prescribed printing position. The printing unit is capable of printing an image based on inputted print data on the recording medium conveyed to the printing position. The detecting unit is capable of detecting the recording medium on an upstream side of the printing position of the printing unit with respect to the conveying direction. The partial printing unit controls the printing unit to execute a printing operation based on at least part of the inputted print data when print data is inputted. The reverse conveying unit conveys the recording medium in an opposite direction to the conveying direction so that a printing region printed by the partial printing unit is in a detection position at which the detecting unit can detect at least part of the printing region. The printing state detecting unit controls the detecting unit to detect a printing state in the printing region conveyed to the detection position of the detecting unit by the reverse conveying unit. The restoration process executing unit executes a process to restore the printing state when the printing state detecting unit detects that the printing state in the printing region is unsatisfactory.

10 Claims, 7 Drawing Sheets

FIG.7 (PROCESS EXECUTED ON THE PRINTING DEVICE)
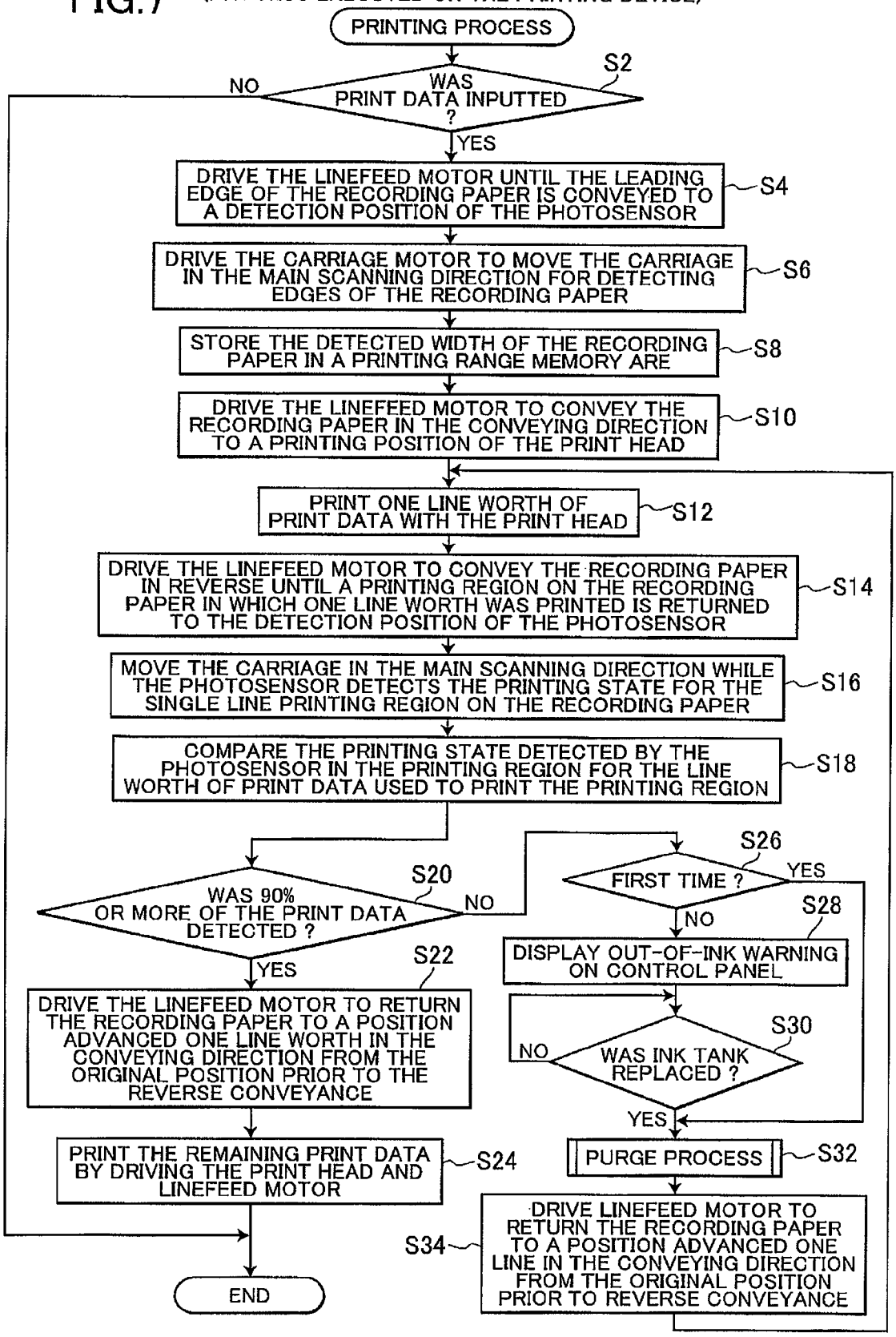

PRINTING DEVICE

CROSS REFERENCE TO RELATED APPLICATION

This application claims priority from Japanese Patent Application No. 2006-90471 filed Mar. 29, 2006. The entire content of this priority application is incorporated herein by reference.

TECHNICAL FIELD

The present invention relates to a printing device.

BACKGROUND

Some conventional printing devices for printing images on recording paper have been provided with a photosensor for detecting printing results on the recording paper. The results picked up by the photosensor can be used to detect problems in the printing state, such as printing that is faint or patchy. If the printing problems are due to a shortage of ink or the like, the printing device will eventually stop printing due to a lack of ink if no steps are taken. Therefore, the device notifies the user of the problem when the photosensor detects a problem in the printing state. In this way, the user can take steps to restore the printing state, such as replacing the ink tanks or ink ribbon, before the printing device loses its ability to print.

SUMMARY

This issue is particularly important to a printing device having a facsimile function for receiving and printing out facsimile data since this printing device prints the facsimile data when the data is received, irrespective of the user's wishes. If the user is not aware when the printing device runs out of ink, the printing device cannot properly print incoming facsimile data. In cases that the printing results are so poor the user cannot read the content, the user must request the sender to retransmit the facsimile data. This inconvenience can be prevented by detecting the printing results and notifying the user of poor results, as described above, so that the user can replace ink tanks or take other measures before the problem becomes worse.

In order to detect printing problems early, it is preferable to perform a process periodically to verify the printing state by printing a test pattern and reading the results of the printed test pattern with a photosensor. In this way, the printing device can detect printing problems at an early stage before the user can perceive the problems. However, printing test patterns periodically simply to check the printing state unnecessarily uses up consumables, such as recording paper and ink.

One method of suppressing this wasteful consumption has been proposed in Japanese unexamined patent application publication No. HEI-6-47921. This publication describes an image recorder including a print head for printing one line at a time at a printing position, and a conveying mechanism for intermittently conveying a recording paper through the printing position one line feed at a time. By repeatedly alternating the printing and conveying operations, the image recorder is able to print an image on the recording paper one line at a time. Further, a photosensor is disposed on the downstream side of the print head in the conveying direction of the recording paper in order to read the results of printing performed by the print head on the downstream side thereof. Hence, the photosensor reads printing results from a printed sheet of recording paper as the sheet is being discharged, confirming whether ink was actually deposited on the recording paper. Since this image recorder checks the printing state at the same time the user is performing a desired printing operation, there is no need to perform test prints, thereby suppressing the unnecessary consumption of recording paper, ink, and the like.

However, by requiring the photosensor to be included along the path on which the recording paper is discharged, the image recorder disclosed in Japanese unexamined patent application publication No. HEI-6-47921 leads to an increase in cost for the overall device.

In view of the foregoing, it is an object of the present invention to provide a printing device having an inexpensive structure that is capable of executing a process for restoring the printing state when printing problems arise, while suppressing the unnecessary consumption of consumables.

In order to attain the above and other objects, the invention provides a printing device including: a conveying unit; a printing unit; a detecting unit; a partial printing unit; a reverse conveying unit; a printing state detecting unit; and a restoration process executing unit. The conveying unit conveys a recording medium in a conveying direction to a prescribed printing position. The printing unit is capable of printing an image based on inputted print data on the recording medium conveyed to the printing position by the conveying unit. The detecting unit is capable of detecting the recording medium on an upstream side of the printing position of the printing unit with respect to the conveying direction. The partial printing unit controls the printing unit to execute a printing operation based on at least part of the inputted print data when print data is inputted. The reverse conveying unit conveys the recording medium in an opposite direction to the conveying direction so that a printing region printed by the partial printing unit is in a detection position at which the detecting unit can detect at least part of the printing region. The printing state detecting unit controls the detecting unit to detect a printing state in the printing region conveyed to the detection position of the detecting unit by the reverse conveying unit. The restoration process executing unit executes a process to restore the printing state when the printing state detecting unit detects that the printing state in the printing region is unsatisfactory.

BRIEF DESCRIPTION OF THE DRAWINGS

In the drawings:

FIG. 7 is a flowchart illustrating steps in a printing process.

DETAILED DESCRIPTION

Figure 1:
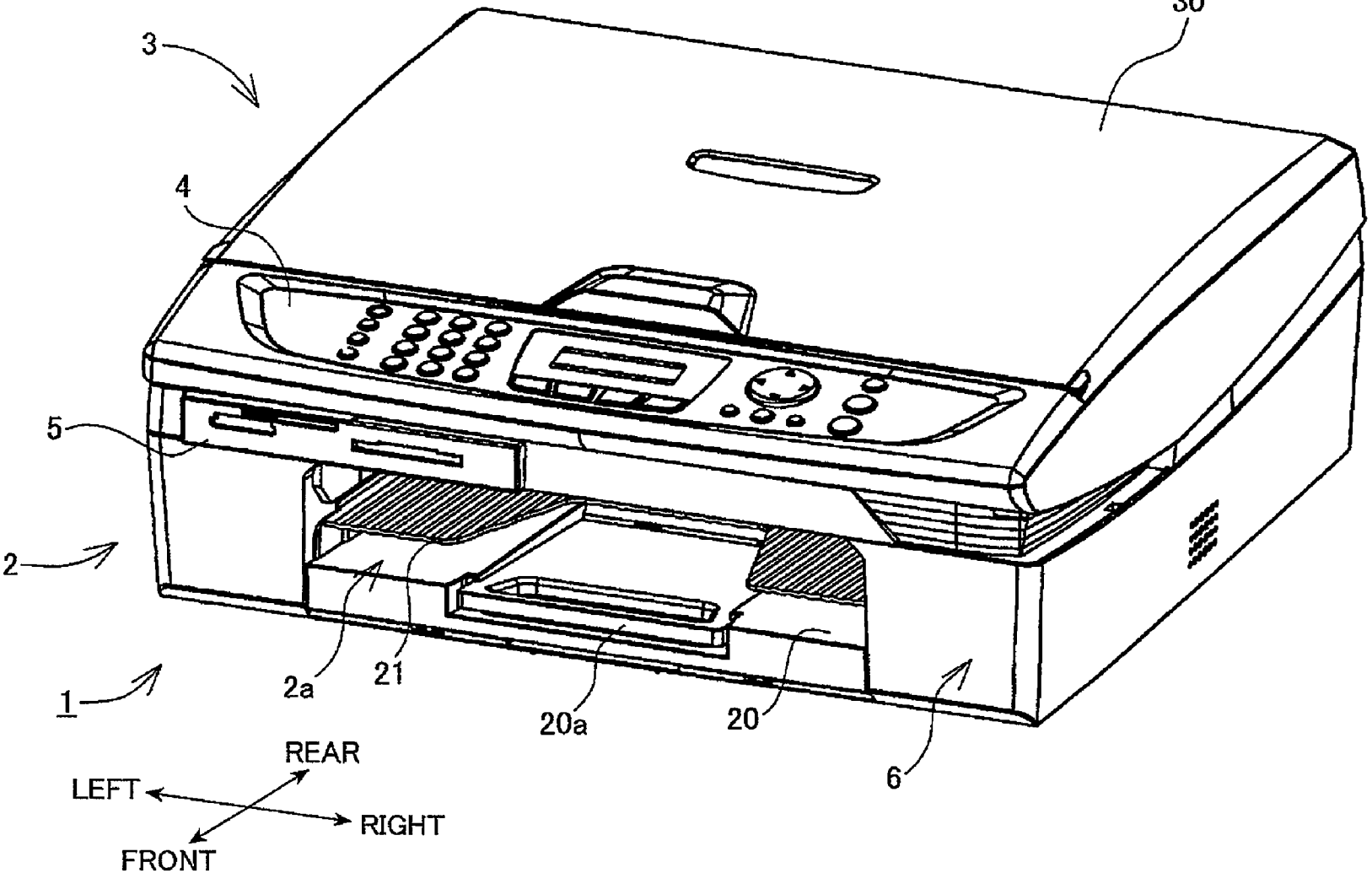
FIG. 1 is a perspective view showing a printing device according to an embodiment of the present invention.

A printing device according to an embodiment of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the printing device is disposed in an orientation in which it is intended to be used. In use, the printing device is disposed as shown in FIG. 1.

A printing device according to an embodiment of the invention will be described with reference to FIGS. 1 through 7. FIG. 1 is a perspective view showing a printing device 1 according to the embodiment. The printing device 1 is a multifunction device that is integrally provided with a printing unit 2 in the lower section and a scanning unit 3 in the upper section and possesses a printer function, scanner function, copier function, and facsimile function. The printing device 1 may be modified to a single-function printer having no scanning unit 3 and, hence, no scanner function or copier function.

The printing device 1 is primarily connected to a computer (not shown) for recording text and images on a recording paper based on text or image data transferred from the computer. However, the printing device 1 may also be connected to an external device such as a digital camera and may record image data inputted from the digital camera on a recording paper. Also, the printing device 1 may be loaded with a memory card or other storage medium and may be capable of recording image data stored on the storage medium on a recording paper.

As shown in FIG. 1, the printing device 1 is substantially shaped as a thin rectangular parallelepiped with greater width and depth dimensions than the height dimension. The printing unit 2 provided in the lower section of the printing device 1 has an opening 2*a* formed on the front surface thereof. A paper tray 20 and a discharge tray 21 are stacked vertically as two levels in the opening 2*a* and are partially exposed therefrom. The paper tray 20 is capable of accommodating a recording paper of various sizes including the A4 size, the B5 size and postcard size. The paper tray 20 includes a slidable tray 20*a* that can be pulled outward when needed, to expand the surface area of the tray. Recording paper accommodated in the paper tray 20 is supplied into the printing unit 2 to undergo a desired image-recording process, and is subsequently discharged onto the discharge tray 21.

The scanning unit 3 disposed in the upper section of the printing device 1 is a flatbed scanner. The printing device 1 includes an original cover 30 on the top thereof that is capable of opening and closing, and a platen glass and an image sensor (not shown in drawing) disposed below the original cover 30. The platen glass functions to support an original document when an image on the document is being scanned. The image sensor is disposed below the platen glass and is capable of scanning in the left-to-right direction of the printing device 1, wherein the main scanning direction of the image sensor is the front-to-rear direction of the printing device 1.

A control panel 4 is provided on the top front surface of the printing device 1 for operating the printing unit 2 and scanning unit 3. The control panel 4 is configured of various operating buttons and a liquid crystal display (LCD). The printing device 1 operates based on operating instructions inputted through the control panel 4 and, when connected to a computer, can operate based on instructions that the computer transmits by means of a printer driver. A slot section 5 in which various small memory cards or other storage media can be inserted is provided in the upper left section of the printing device 1 on the front surface thereof. A user can input operating instructions via the control panel 4 to read image data stored on a memory card that is inserted into the slot section 5 and to display the image data on the LCD, and can input further instructions to record a desired image on a recording paper using the printing unit 2.

Figure 2:
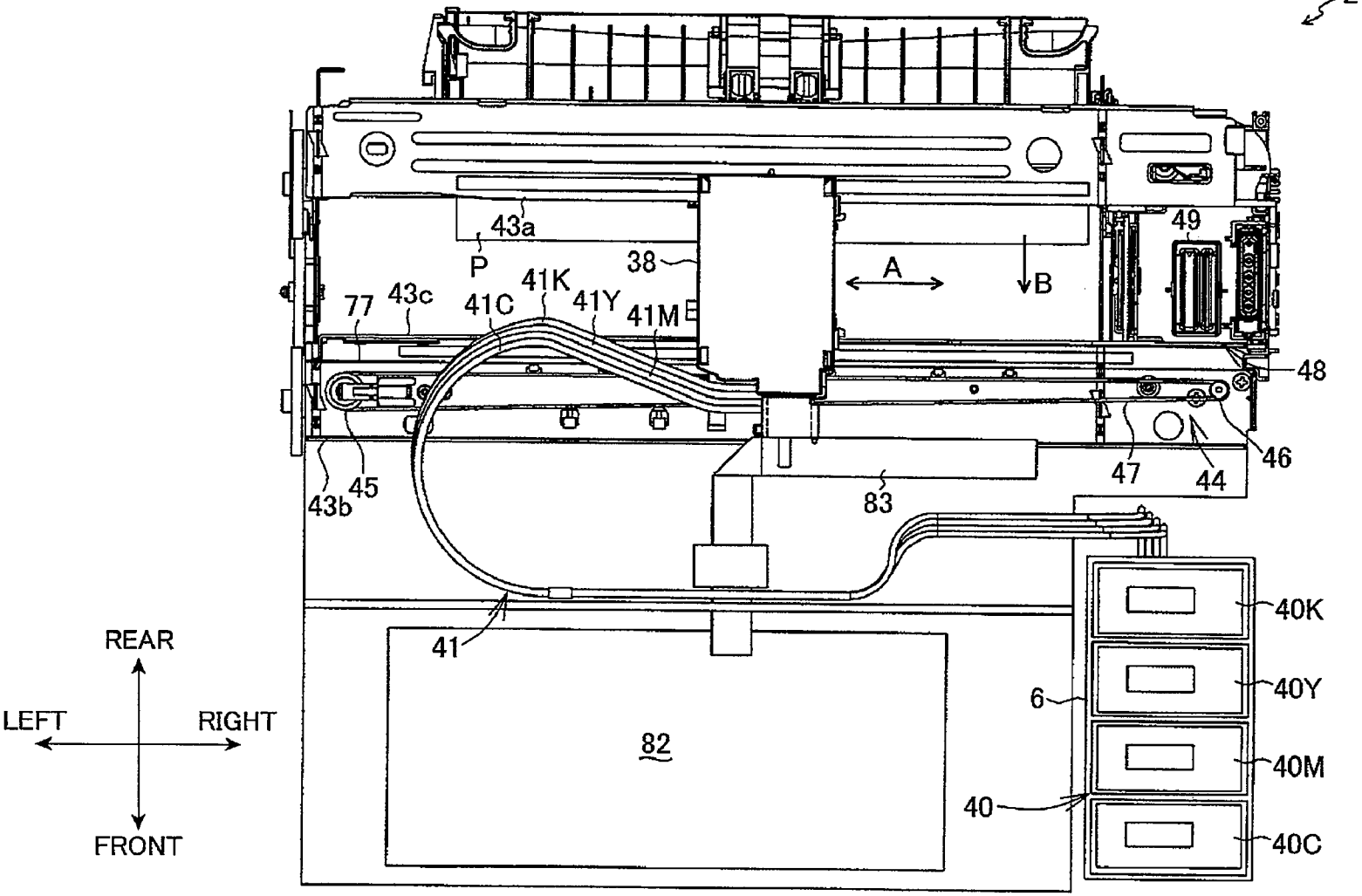
FIG. 2 is a plan view showing the primary structure of a printing unit.
Figure 3:
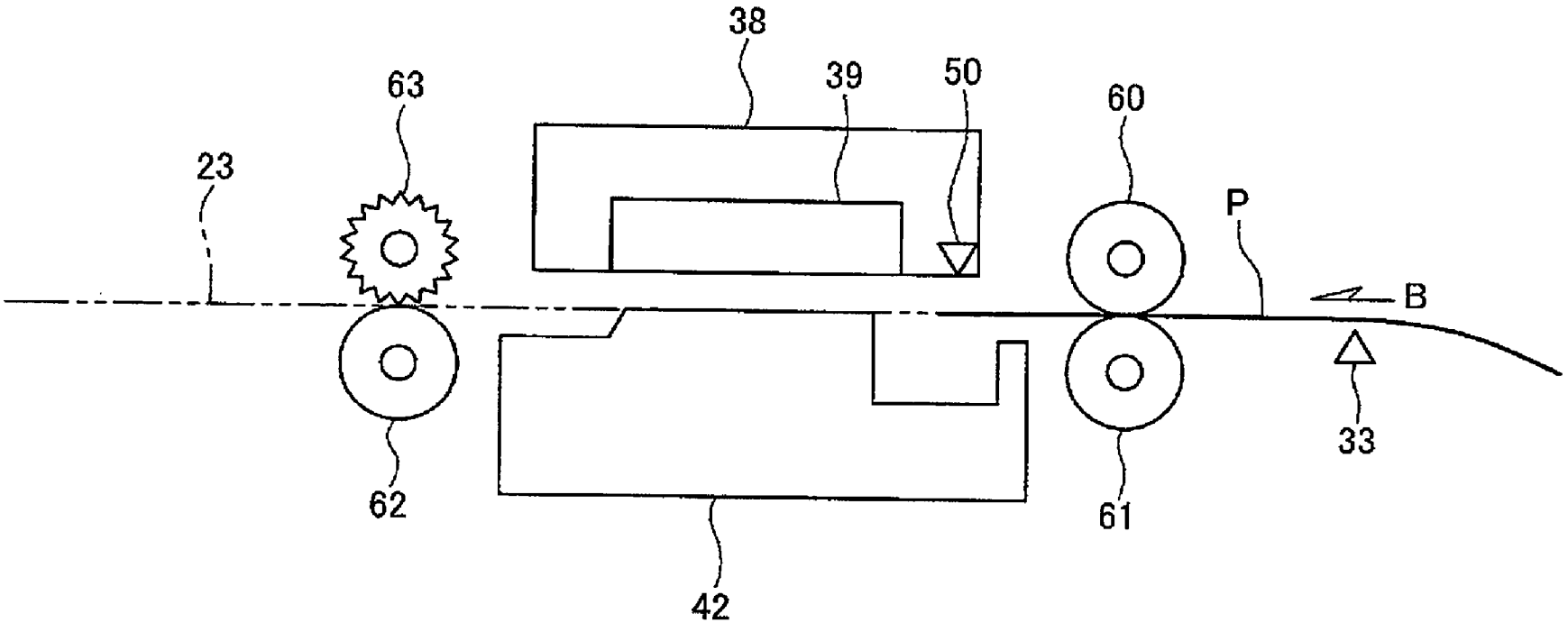
FIG. 3 is an explanatory diagram conceptually illustrating the conveying state of a sheet of recording paper.

FIG. 2 is a plan view showing the primary structure of the printing unit 2. The printing unit 2 includes a carriage 38 that reciprocates in the main scanning direction A (left-to-right direction), and a recording head 39 (see FIG. 3) mounted in the carriage 38. The recording head 39 ejects microdroplets of ink in the colors cyan (C), magenta (M), yellow (Y), and black (Bk) to form images on the recording paper. The ink is supplied from ink tanks 40 that are provided in the printing device 1 separately from the recording head 39 via ink supply tubes 41. A recording paper is picked up from the paper tray 20, is conveyed rearwardly, turned upwardly at the rear side of the printing device 1, and then conveyed forwardly along a conveying path 23 (FIG. 3). The recording head 39 records an image on the paper, as the carriage 38 is scanned over the forwardly-being-conveyed paper.

More specifically, a pair of guide rails 43*a* and 43*b* are disposed at a prescribed distance from each other in the conveying direction B of the recording paper. The guide rails 43*a* and 43*b* extend in the main scanning direction A. The carriage 38 is slidably disposed across both of the guide rails 43*a* and 43*b*. The guide rail 43*a* is disposed upstream of the guide rail 43*b* in the conveying direction B (forward direction). The guide rail 43*a* is plate-shaped with a dimension in the main scanning direction A greater than the scanning path of the carriage 38. The top surface of the guide rail 43*a* slidably supports the upstream end of the carriage 38.

The guide rail 43*b* disposed on the downstream side in the conveying direction B is also plate-shaped with a dimension in the main scanning direction A substantially the same as that of the guide rail 43*a*. The guide rail 43*b* has an edge part 43*c* that is bent upward at substantially a right angle for supporting the downstream end of the carriage 38. The carriage 38 is slidably supported on the top surface of the guide rail 43*b* and grips the edge part 43*c* with a roller or the like (not shown). Hence, the carriage 38 is slidably supported on the guide rails 43*a* and 43*b* and is capable of reciprocating in the main scanning direction with the edge part 43*c* of the guide rail 43*b* serving as a positional reference.

As shown in FIG. 2, a belt drive mechanism 44 is provided on the top surface of the guide rail 43*b*. The belt drive mechanism 44 is configured of a drive pulley 45 and a follow pulley 46 disposed near widthwise ends of the guide rail 43*b* in the main scanning direction A, and an endless timing belt 47 stretched around the drive pulley 45 and follow pulley 46 and having teeth on the inside surface thereof. A carriage motor 73 (see FIG. 6) inputs a driving force into the shaft of the drive pulley 45 for rotating the drive pulley 45. The rotation of the drive pulley 45 causes the timing belt 47 to move in a circuit. Although the timing belt 47 is an endless belt in the embodiment, a belt with ends may also be used by fixing both ends to the carriage 38.

The carriage 38 is fixed to the timing belt 47 so that circuitous movement of the timing belt 47 causes the carriage 38 to reciprocate over the guide rails 43*a* and 43*b* using the edge part 43*c* as reference. The recording head 39 is mounted in the carriage 38 having this construction so that the recording head 39 also moves reciprocatingly in the main scanning direction A. A strip-like linear encoder for detecting the carriage 38 is provided along the edge part 43*c*. The reciprocating motion of the carriage 38 is controlled based on an encoder amount of the linear encoder 77 detected by a photointerrupter (not shown).

As shown in FIG. 2, a maintenance unit including a purging device 48 and a waste ink tray (not shown) is provided in a region through which the recording medium does not pass, that is, in a region outside the image-recording range of the recording head 39. The purging device 48 functions to draw out ink, air bubbles and foreign matter from nozzles 53*a* (see FIG. 4) and the like in the recording head 39. The purging device 48 includes a pump mechanism (not shown) connected to the recording head 39 via a cap 49, and a moving mechanism (not shown) for moving the cap 49 to contact or separate from the nozzle surface of the recording head 39. When an operation is performed to remove air bubbles and the like from the recording head 39, the carriage 38 is moved so that the recording head 39 is positioned above the cap 49. Subsequently, the moving mechanism moves the cap 49 upward against the bottom surface of the recording head 39 so as to form a seal over the nozzles 53*a* formed in this bottom surface. The pump mechanism coupled to the cap 49 then draws out ink from the nozzles 53*a* and the like in the recording head 39.

While not shown in the drawings, the waste ink tray is also disposed outside of the image-recording range but within the moving range of the carriage 38 for receiving ink that has been flushed out of the recording head 39. This maintenance unit can perform such maintenance as removing air bubbles and ink of different colors that has mixed from the recording head 39.

The ink tanks 40 are accommodated in an ink tank accommodating section 6 disposed in the front right side of the printing unit 2, as shown in FIG. 1. As shown in FIG. 2, the ink tanks 40 are provided separately from the carriage 38 and recording head 39 and supply ink to the carriage 38 via the ink supply tubes 41.

The ink tanks 40 include four ink tanks 40C, 40M, 40Y, and 40K accommodating ink of the respective colors cyan (C), magenta (M), yellow (Y), and black (Bk). The four ink tanks 40 are mounted at prescribed positions in the ink tank accommodating section 6. While not shown in detail in the drawings, each of the ink tanks 40 has a cartridge structure having a casing formed of synthetic resin that is filled with the respective color of ink. These cartridge type ink tanks 40 are detachably mounted in the ink tank accommodating section 6 from above. An opening is formed in the bottom surface of the casing for each ink tank 40 in order to supply the ink stored in the casing. The opening is sealed with a check valve. Joints for opening these check valves are provided in the ink tank accommodating section 6. After mounting the ink tanks 40 in the ink tank accommodating section 6, ink can be supplied through the openings in the bottom of the casing by opening the check valves.

The printing device 1 performs image recording with four colors of ink. However, the number of ink tanks may be changed. For example, the number of ink tanks may be increased to perform image recording in six colors or eight colors. Further, the ink tanks 40 is not restricted to a cartridge type ink tank, but may be any construction that is appropriately filled with ink and that remains stationary inside the device. As described above, ink is supplied from the ink tanks 40 mounted in the ink tank accommodating section 6 to the recording head 39 via the ink supply tubes 41. The ink supply tubes 41 are provided independently for each color. The ink supply tubes 41 (41C, 41M, 41Y, 41K) are tubes formed of synthetic resin and are flexible so as to be able to bend when the carriage 38 moves in a scanning motion. Although not shown in detail in the drawings, the opening in one end of each of the ink supply tubes 41 is connected to one of the joints provided in the ink tank accommodating section 6 at positions corresponding to each mounted ink tank. The ink supply tube 41C corresponds to the ink tank 40C and supplies cyan ink therefrom. Similarly, the ink supply tubes 41M, 41Y, and 41K correspond to the ink tanks 40M, 40Y, and 40K and supply the corresponding ink colors magenta, yellow, and black therefrom.

From the ink tank accommodating section 6, the ink supply tubes 41 are led along the width direction of the printing device 1 to a position near the center thereof, at which position the ink supply tubes 41 are fixed to an appropriate member on the frame or the like. However, a section of each ink supply tube 41 from the fixed part to the carriage 38 is curved substantially in a U-shape, is not fixed to the device frame or the like, and changes in shape as the carriage 38 reciprocates. Hence, as the carriage 38 moves toward the right side in the reciprocating direction, each ink supply tube 41 moves in the same direction of the carriage 38 while flexing so that the curved radius of the U-shaped curved part grows smaller. When the carriage 38 moves to the left side in the reciprocating direction, the ink supply tubes 41 move in the same direction while flexing so that the curved radius of the U-shaped curved part grows larger.

A main circuit board 82 (FIG. 6) transfers recording signals and the like to the recording head 39 via a flat cable 83. The flat cable 83 is an insulated ribbon cable configured of conductors for transmitting electric signals coated in a synthetic resin film, such as a polyester film or the like. The flat cable 83 connects to the main circuit board 82. The flat cable 83 is electrically connected on one end to the main circuit board 82 and on the other end to a control circuit board (not shown) of the recoding head 39. The flat cable 83 extends from the carriage 83 in the reciprocating direction of the carriage 38, and is bent vertically into substantially a U-shape. The U-shaped part is fixed to no other member and can change its shape as the carriage 38 reciprocates.

FIG. 3 is an explanatory diagram conceptually showing the conveying state of the recording paper P. As shown in FIG. 3, a platen 42 is disposed in opposition to the recording head 39. The platen 42 spans the center region within the reciprocating range of the carriage 38 through which the recording paper P passes. The platen 42 is sufficiently wider than the maximum width of the recording paper P that can be used in the printing device 1, so that both side edges of the recording paper P always pass over the platen 42. The top surface of the platen 42 should have a color of a different reflectance from the white color of a common sheet of recording paper P, and is preferably black.

A conveying roller 60 and a pinch roller 61 that contacts the conveying roller 60 with pressure are provided upstream of the carriage 38 for pinching the recording paper P conveyed along the conveying path 23 and conveying the recording paper P over the platen 42. A discharge roller 62 and a spur roller 63 opposing the discharge roller 62 are provided downstream of the carriage 38 for pinching and conveying the recording paper P with an image recorded thereon. A linefeed motor 71 (see FIG. 6) generates a driving force that is transmitted to the conveying roller 60 and discharge roller 62 for driving these rollers intermittently at a prescribed linefeed width. A rotary encoder 76 (see FIG. 6) is disposed on the conveying roller 60. Since rotation of the conveying roller 60 and discharge roller 62 is synchronized, the rotation of both rollers is controlled by detecting the rotary encoder 76 with a photointerrupter.

The pinch roller 61 is capable of rotating freely and is urged toward the conveying roller 60 so as to press against the conveying roller 60 with a prescribed force. When a sheet of the recording paper P enters between the conveying roller 60 and pinch roller 61, the pinch roller 61 retracts a distance equivalent to the thickness of the sheet and pinches the sheet together with the conveying roller 60. Therefore, the rotational force of the conveying roller 60 is reliably transmitted to the recording paper P. The spur roller 63 is similarly disposed in opposition to the discharge roller 62. However, since the spur roller 63 presses against the side of the recording paper P that has just been printed, the spur roller 63 has a spur-like irregular surface in order not to degrade the image recorded on the recording paper P.

When the recording paper P is interposed between the conveying roller 60 and pinch roller 61, the conveying roller 60 conveys the recording paper P intermittently over the platen 42 at the prescribed linefeed width. After the recording paper P is conveyed each linefeed, the recording head 39 scans over the recording paper P and prints one line's worth of image. Thus, while the recording paper P is being conveyed intermittently at the prescribed linefeed width, lines of image are recorded beginning from the leading edge side. Subsequently, the leading edge of the printed recording paper P is interposed between the discharge roller 62 and spur roller 63. Consequently, the recording paper P is conveyed intermittently at the prescribed linefeed width, with the leading edge of the recording paper P interposed between the discharge roller 62 and spur roller 63 and the trailing edge interposed between the conveying roller 60 and pinch roller 61, while the recording head 39 executes the printing process described above.

As the recording paper P continues to be conveyed in this way, the trailing edge of the recording paper P eventually passes through the conveying roller 60 and pinch roller 61 until these rollers no longer have a grip on the recording paper P. At this time, the recording paper P is conveyed intermittently at the prescribed linefeed width while pinched between only the discharge roller 62 and spur roller 63, while the recording head 39 performs the printing described above. Once the entire prescribed region of the recording paper P has been printed, the discharge roller 62 is driven to rotate continuously so that the recording paper P interposed between the discharge roller 62 and spur roller 63 is discharged onto the discharge tray 21.

The linefeed motor 71 (see FIG. 6) for driving the conveying roller 60 and discharge roller 62 is configured to rotate in forward and reverse directions. When the linefeed motor 71 rotates in the forward direction, the conveying roller 60 and discharge roller 62 are driven to rotate in the conveying direction B. On the other hand, when the linefeed motor 71 rotates in reverse, the conveying roller 60 and discharge roller 62 are driven to rotate in a direction for conveying the recording paper P in a direction opposite the conveying direction B.

Figure 4:
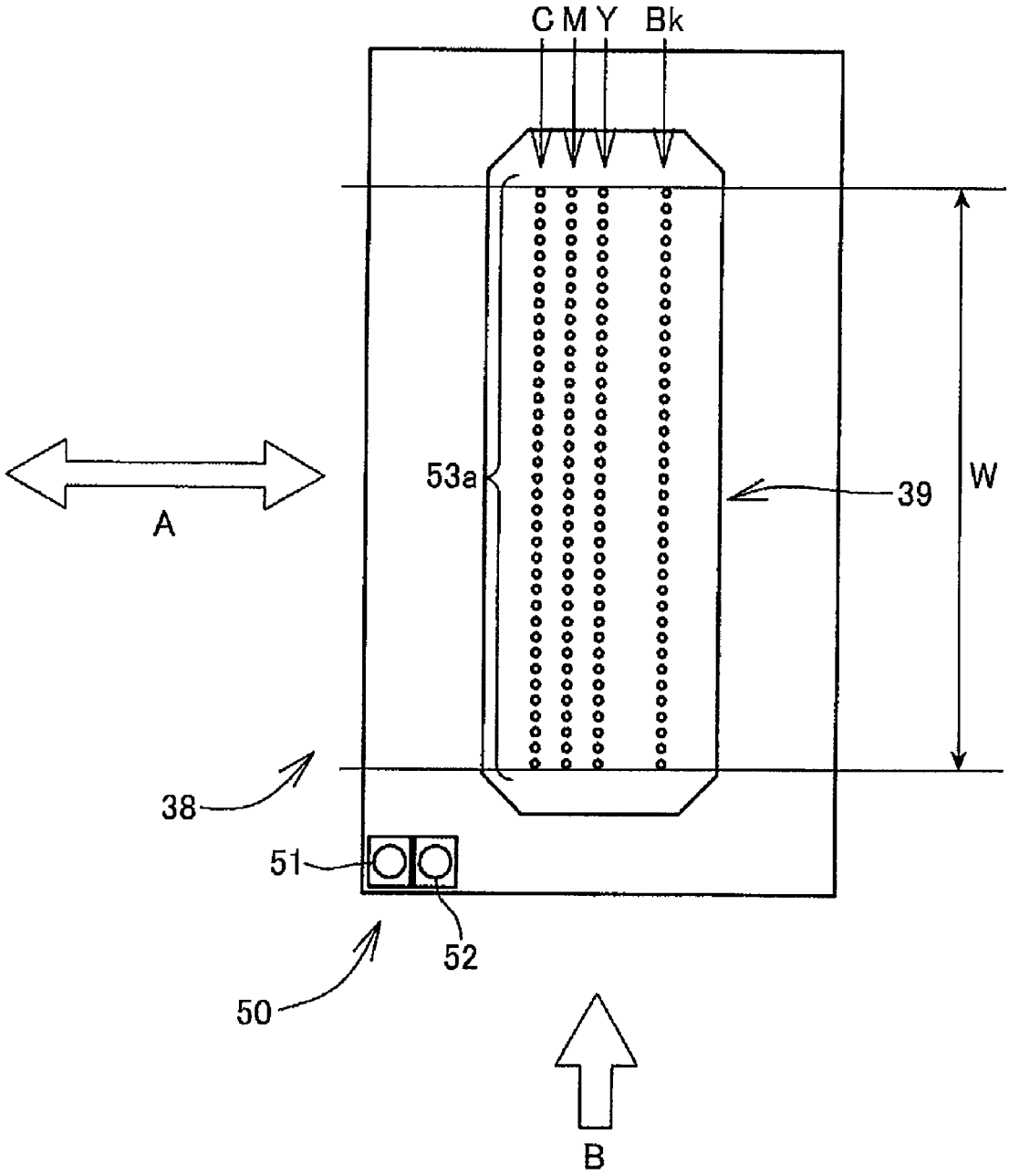
FIG. 4 is a bottom view showing the structure on the bottom surface of a carriage.

As shown in FIG. 3, a photosensor 50 is also mounted on the carriage 38 together with the recording head 39. As shown in FIG. 4, the photosensor 50 is configured of a light-emitting element 51 for emitting a light toward the platen 42, and a light-receiving element 52 for receiving the reflected light.

Since the top surface of the platen 42 has a color such as black with a different reflectance than the recording paper P, as described above, the detection value (AD detection value (analog-to-digital converted value)) outputted from the photosensor 50 is a low value when the recording paper P is not present on the platen 42. This is because the light-receiving element 52 receives light reflected off the platen 42, which has a low reflectance. However, when the recording paper P is present over the platen 42, the detection value outputted from the photosensor 50 is a high value because the light-receiving element 52 receives light reflected off the recording paper P, which has a high reflectance. Hence, the printing device 1 can detect the presence of paper based on the difference in the amount of reflected light received in the photosensor 50.

As shown in FIG. 3, the photosensor 50 is mounted on the carriage 38 on the upstream side of the recording head 39 in the conveying direction B and reciprocates together with the carriage 38 along the main scanning direction (the direction orthogonal to the plane of the drawing in FIG. 3). Mounting the photosensor 50 on the carriage 38 together with the recording head 39 is advantageous for achieving a more compact printing device 1 since there is no need to provide a carriage for scanning the photosensor 50 separate from the carriage 38 for scanning the recording head 39. Further, by disposing the photosensor 50 on the upstream side of the recording head 39 in the conveying direction B, the photosensor 50 can detect the left and right edge positions of the recording paper P before the recording head 39 prints on the recording paper P.

As shown in FIG. 3, a paper sensor 33 is also provided along the conveying path 23 on the upstream side of the carriage 38 in the conveying direction B. The paper sensor 33 functions to detect the leading edge of the recording paper P conveyed toward the conveying roller 60. The paper sensor 33 is disposed upstream of the conveying roller 60 and is configured of a probe that rotates when contacted by the recording paper P, and a photointerrupter for detecting the rotation of the probe, for example.

FIG. 4 is a bottom view showing the structure on the bottom surface of the carriage 38. As shown in FIG. 4, the nozzles 53*a* are formed in the bottom surface of the recording head 39 in rows extending in the conveying direction B for each of the ink colors. A row of nozzles (ink ejection holes) 53*a* is formed for each of the ink colors in the conveying direction B, and the rows are juxtaposed in the main scanning direction A of the carriage 38. The pitch and number of the nozzles 53*a* arranged in the conveying direction B for each color are set appropriately with consideration for the resolution of the images to be recorded and the like. It is also possible to increase or decrease the number of rows of the nozzles 53*a* to correspond to the number of ink colors. As shown in FIG. 4, a width W of rows of the nozzles 53*a* extending in the conveying direction B is equivalent to the linefeed width. Further, the photosensor 50 is disposed upstream of the recording head 39 on the carriage 38 in the conveying direction B. As described above, the photosensor 50 includes the light-emitting element 51 configured of a light-emitting diode, and the light-receiving element 52 configured of an optical sensor.

Figure 5:
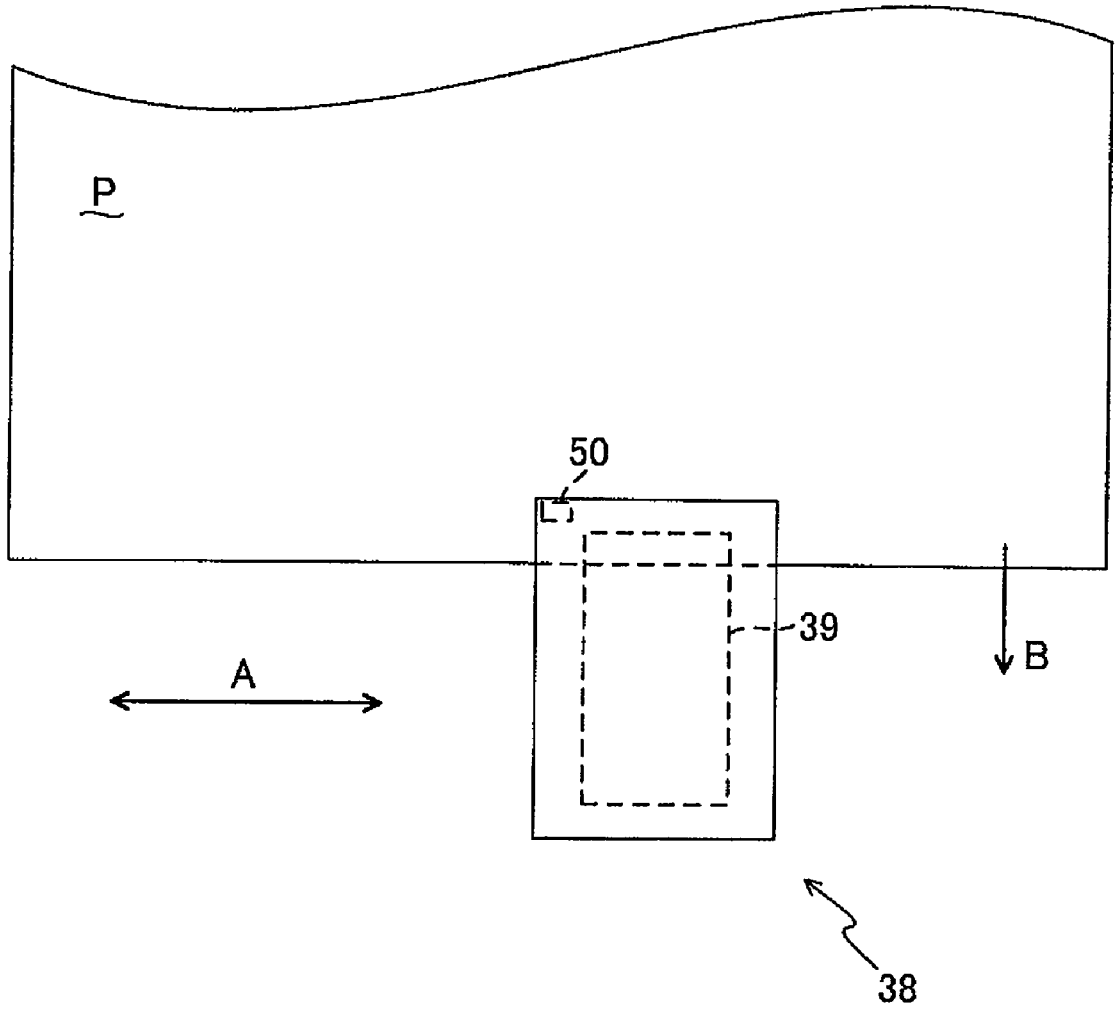
FIG. 5 is a plan view showing the operations of the carriage during edge detection.

FIG. 5 is a plan view illustrating operations of the carriage 38 when detecting edges of the recording paper P. First, the carriage 38 moves the photosensor 50 to a widthwise center position of the recording paper P, as shown in FIG. 5. The center position is determined based on the size of the recording paper P specified in recording paper information included in the print data. While the photosensor 50 is at this center position, a prescribed electric current is supplied to the light-emitting element 51 of the photosensor 50, causing the light-emitting element 51 to emit a prescribed amount of light. The amount of light emitted from the light-emitting element 51 may be adjusted to a suitable level based on the type of recording paper P. For example, if the recording paper P is a glossy paper that has received a prescribed surface treatment for printing photographs and, thus, has a higher reflectance than normal paper, the amount of light received by the light-receiving element 52 will be greater in this case. The amount of received light will also vary according to the color of the recording paper P. Accordingly, the amount of light emitted by the light-emitting element 51 is adjusted so that the light-receiving element 52 will receive a fixed amount of light when the recording paper P is present.

The amount of light emitted from the light-emitting element 51 is adjusted as follows. When at the center position, the photosensor 50 is turned on, at which time the light-emitting element 51 is controlled to emit an initial amount of light and the light-receiving element 52 acquires an amount of reflected light. This initial amount of emitted light is too small to meet the target value of received light for all types of paper. Therefore, the amount of light that the light-receiving element 52 initially receives is smaller than the target value. Subsequently, the amount of light emitted from the light-emitting element 51 is increased by prescribed units. When the amount of light received by the light-receiving element 52 reaches the target value, the amount of light emitted from the light-emitting element 51 is determined to be the adjusted value.

Next, a process for detecting the side edges of the recording paper is performed near the leading edge of the recording paper P. Generally, a computer or the like transmits print data to the printing device 1 in order to perform a printing operation on the recording paper P. The print data includes recording paper information that indicates the size of the recording paper P. Hence, the printing device 1 can control the operations of the carriage 38 and recording head 39 based on this recording paper information. However, the recording paper P is not always conveyed precisely at the same position over the platen 42. The position of the recording paper P in the width direction on the platen 42 differs slightly for each sheet of recording paper P conveyed. It is particularly important to know the edge positions of the recording paper P precisely when performing borderless printing in which printing is performed all the way to the edges of the recording paper P in order to avoid unprinted white lines on the edges of the recording paper P and to minimize the amount of ink that the recording head 39 ejects beyond the edges of the recording paper P. By accurately learning the edge positions, it is possible to control the operations of the carriage 38 and recording head 39 based on these edge positions to print accurately up to the edges of the recording paper P.

Figure 6:
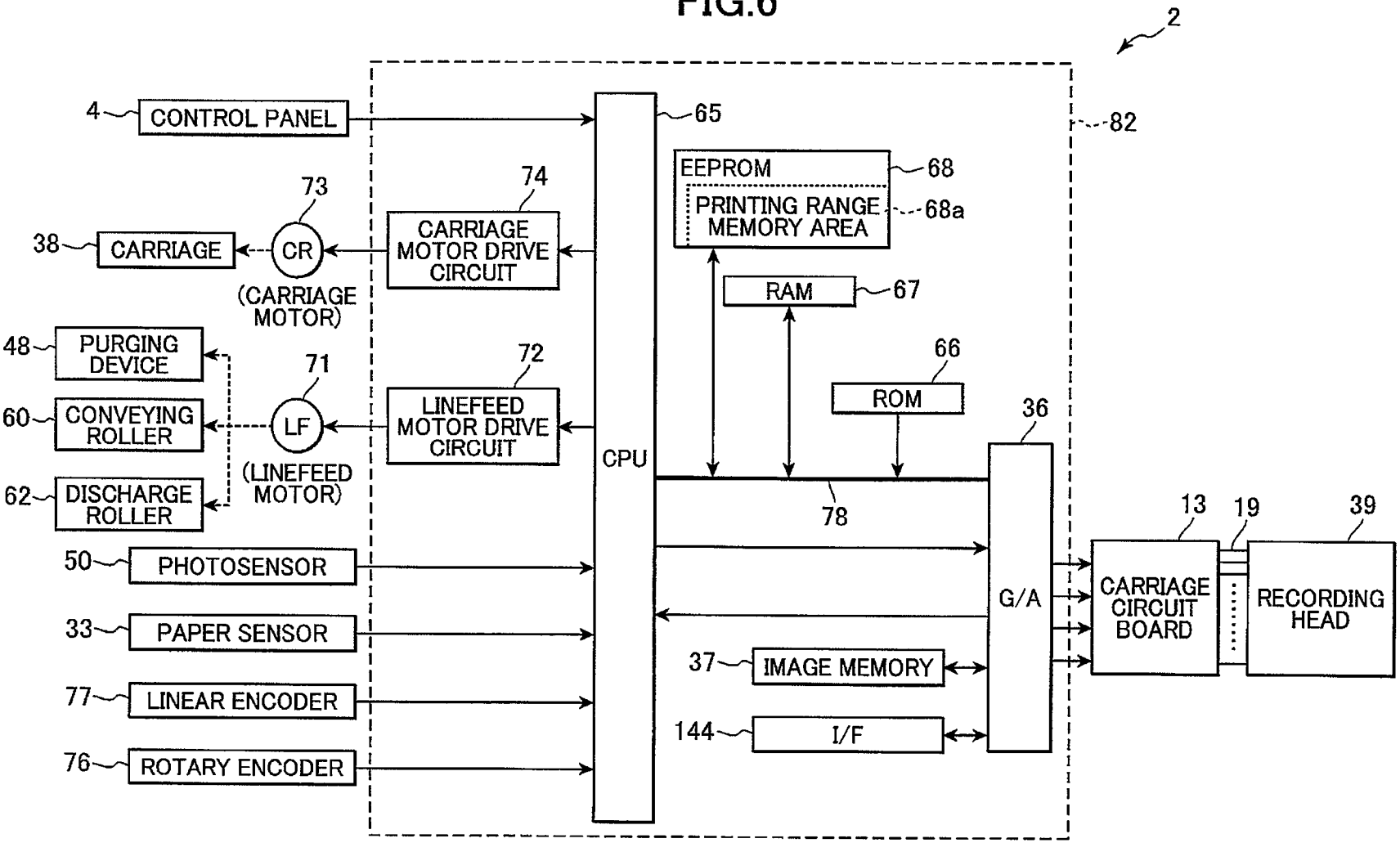
FIG. 6 is a block diagram showing the electrical circuit structure of the printing unit.

FIG. 6 is a block diagram showing the electrical circuit configuration of the printing unit 2. A controller for controlling the printing unit 2 includes the main circuit board 82 and a carriage circuit board 13. The main circuit board 82 is provided with a microcomputer (CPU) 65 configured of a single chip; a ROM 66 storing various control programs executed by the CPU 65, and fixed value data; a RAM 67 for temporarily storing various data; a EEPROM 68; an image memory 37; and a gate array (G/A) 36.

The CPU 65 generates a print timing signal and a reset signal according to a control program stored in the ROM 66 and transfers these signals to the gate array 36 described below. The CPU 65 is also connected to the control panel 4 through which the user inputs a print command and the like, a carriage motor drive circuit 74 for driving the carriage motor 73 to operate the carriage 38, a linefeed motor drive circuit 72 for driving the linefeed motor 71, the photosensor 50, the paper sensor 33, the linear encoder 77, and the rotary encoder 76. The CPU 65 controls operations of all devices connected thereto.

The CPU 65 is a central processing unit that controls overall operations of the printing device 1. The CPU 65 executes various programs, including a program for implementing the process shown in the flowchart of FIG. 7.

The ROM 66 is a non-rewritable memory that stores various programs, including the program for implementing a printing process described later (see FIG. 7), and fixed values. The EEPROM 68 is provided with a printing range memory area 68*a* for storing the left and right edge positions of the recording paper P detected with the photosensor 50 and the linear encoder 77. By executing a printing operation using the left and right edge positions stored in the printing range memory area 68*a*, the image can be aligned accurately with the recording paper P so that the image printed by the recording head 39 fits reliably between the left and right edge positions of the recording paper P. In a memory area separate from the printing range memory area 68*a*, the EEPROM 68 also stores a printing problem detection number described later.

The image memory 37 stores print data to be printed. Print data includes data received from an external device, such as a personal computer, another facsimile device, or a digital camera; data that the scanning unit 3 scans from an original; and data read from a memory card mounted in the slot section 5.

The gate array 36 outputs drive signals for recording print data on the recording paper P, a transfer clock for synchronizing with the drive signal, a latch signal, a parameter signal for generating a basic drive waveform signal, and an ejection timing signal outputted at fixed intervals based on a timing signal transferred from the CPU 65 and the print data stored in the image memory 37. The signals outputted from the gate array 36 are transferred to the carriage circuit board 13. The carriage circuit board 13 includes a print head driver.

The gate array 36 receives print data transferred from a computer or other external device via an interface 144, such as a USB interface, and stores the print data in the image memory 37. Based on the data transferred from the external device such as the computer via the interface 144, the gate array 36 generates a data reception interrupt signal, and transfers the data reception interrupt signal to the CPU 65. Various signals are transferred between the gate array 36 and carriage circuit board 13 over a harness cable connecting the two.

The carriage circuit board 13 functions to drive the recording head 39 according to a print head driver mounted thereon. The print head driver of the carriage circuit board 13 is connected to the recording head 39 by a flexible printed wiring board 19. The flexible printed wiring board 19 includes a copper foil wiring pattern formed on a polyimide film having a thickness of 50-150 μm. The CPU 65 controls the print head driver via the gate array 36 mounted on the main circuit board 82 to apply a drive pulse having a waveform conforming to the print mode to piezoelectric actuators constituting the recording head 39 so that the recording head 39 ejects prescribed amounts of ink.

The CPU 65, ROM 66, RAM 67, EEPROM 68, and gate array 36 described above are connected via a bus line 78.

The linefeed motor 71 is capable of rotating in forward and reverse directions and functions to drive the conveying roller 60, discharge roller 62, and purging device 48. A drive transmission switching mechanism (not shown) is provided for selectively switching between a state in which the driving force generated by the linefeed motor 71 is transferred to the conveying roller 60 and discharge roller 62, and a state in which the driving force generated by the linefeed motor 71 is transferred to the purging device 48.

The linear encoder 77 functions to detect the amount of movement made by the carriage 38. A photointerrupter (not shown) detects an encoder amount in the linear encoder 77 by which the reciprocation of the carriage 38 is controlled. The rotary encoder 76 functions to detect the amount of rotation in the conveying roller 60. A photointerrupter (not shown) detects an encoder amount of the rotary encoder 76 by which the conveying roller 60 is controlled. Hence, as the conveying roller 60 conveys a sheet of recording paper P, the rotary encoder 76 can detect the actual conveyed position of the recording paper P at a prescribed precision.

Next, a printing operation performed by the printing device 1 having the above construction will be described with reference to FIG. 7. FIG. 7 is a flowchart illustrating steps in the printing process. The CPU 65 executes the printing process based on a program stored in the ROM 66. According to this printing process, the printing device 1 forms an image on a sheet of the recording paper P by repeatedly and alternately performing a printing operation in which the recording head 39 is reciprocated in the main scanning direction A while ejecting ink toward the recording paper P, and a conveying operation in which the recording paper P is conveyed in the conveying direction B. The printing process of FIG. 7 is executed at prescribed intervals after the power to the printing device 1 is turned on. Each time the printing process is started being executed, the printing problem detection number stored in the EEPROM 68 is first initialized to zero(0).

When the printing process of FIG. 7 is started, the CPU 65 determines in S2 whether print data has been inputted in the image memory 37 (see FIG. 6). More specifically, the CPU 65 determines whether print data has been inputted from an external device such as a personal computer, facsimile device, or digital camera connected by a cable. The CPU 65 determines whether print data has been scanned by the scanning unit 3 and subsequently inputted into the image memory 37 when the printing device 1 performs a copy function for printing data scanned by the scanning unit 3. The CPU 65 determines whether print data has been read from a memory card and subsequently inputted into the image memory 37 when the printing device 1 performs a function for directly printing data stored on the memory card without the use of a personal computer.

The CPU 65 ends the process if no print data has been inputted into the image memory 37 (S2: NO). However, when print data has been received and stored in the image memory 37 (S2: YES), then in S4 the CPU 65 drives the linefeed motor 71 to convey a sheet of the recording paper P until the leading edge of the recording paper P arrives at a detection position. The detection position is a position at which the photosensor 50 mounted on the carriage 38 can detect the leading edge of the recording paper P as the carriage 38 moves in the main scanning direction A. More specifically, the detection position is a prescribed distance upstream with respect to the conveying direction B of the printing position at which the recording head 39 performs printing. After a feeding roller (not shown) feeds a sheet of the recording paper P until the leading edge of the recording paper P passes the paper sensor 33 (see FIG. 3) and arrives at the conveying roller 60, the CPU 65 drives the linefeed motor 71 a prescribed amount to rotate the conveying roller 60 in a direction for conveying the recording paper P in the conveying direction B. By driving the linefeed motor 71 the prescribed amount, the leading edge of the recording paper P pinched between the conveying roller 60 and pinch roller 61 can be conveyed to the detection position of the photosensor 50.

In S6 the CPU 65 drives the carriage motor 73 to move the carriage 38 in the main scanning direction A for detecting the left and right edge positions of the recording paper P. In S8 the CPU 65 stores data of the detected left and right edge positions in the printing range memory area 68*a*.

In S10 the CPU 65 drives the linefeed motor 71 in the forward direction to rotate the conveying roller 60 in a direction for conveying the recording paper P in the conveying direction B until the recording paper P is conveyed to the printing position of the recording head 39. In 512 the CPU 65 drives the carriage motor 73, while the recording head 39 performs a printing operation based on the first line worth of print data.

In S14 the CPU 65 drives the linefeed motor 71 to rotate in the reverse direction, causing the conveying roller 60 to rotate in a direction for conveying the recording paper P in the opposite direction of the conveying direction B, so that a printing region in which the first line worth of print data was printed on the recording paper P is returned to the detection position of the photosensor 50. In S16 the CPU 65 drives the carriage motor 73 to move the carriage 38 in the main scanning direction A, while the photosensor 50 detects the printing state in the initial printed line on the recording paper P.

As described above with reference to FIG. 4, the photosensor 50 is configured of the light-emitting element 51 for irradiating light, and the light-receiving element 52 for receiving the reflected light. If ink has not been printed on an area of the recording paper P so that light received by the light-receiving element 52 is reflected off of the recording paper P, the AD detection value outputted from the photosensor 50 will be high since the recording paper P has a high reflectance. However, if ink having a relatively lower reflectance is printed in the printing region of the recording paper P, the AD detection value outputted from the photosensor 50 will be relatively low. Hence, the presence of ink can be detected in this position based on whether the AD detection value is greater than a threshold value. The AD detection values outputted from the light-receiving element 52 are stored in the RAM 67 in association with encoder amounts of the linear encoder 77 serving as data indicating the position of the carriage 38. Since the photosensor 50 outputs AD detection values at prescribed timings, if the carriage 38 is moved at a high speed, the photosensor 50 may only be able to output a single AD detection value for each encoder amount, for example, since the photosensor 50 is also moving at the same high speed. In this way, the printing device 1 can detect the presence of ink (printing state) at each position in the main scanning direction A within a single line worth of the printed region based on whether the AD detection value detected at the corresponding position in the main scanning direction A is greater than the threshold value. The printing device 1 according to the embodiment detects the existence of ink for positions at which one of the colors cyan, magenta, yellow, or black should be printed based on the print data.

When there is a sufficient amount of ink remaining in the ink tanks 40 and no problems such as obstructed nozzles have occurred, most areas are properly printed based on the print data and are detected on the recording paper P. However, if there is insufficient ink remaining in the ink tanks 40 or if the nozzles 53*a* become obstructed or the like, the printed areas may include missing dots, patchy ink, and the like. Consequently, the printing number detected on the recording paper P (the total number of positions determined to have been printed with ink) is less than the printing number expected based on the print data. In such a case, satisfactory printing results will not be obtained if printing is continued without taking the appropriate steps. Therefore, when the printing state in the initial line of printed data is unsatisfactory in the printing process according to the embodiment, the CPU 65 performs an operation to restore the printing state.

Here, an unsatisfactory printing state signifies that the ratio of actual printed areas on the recording paper P to expected printed areas based on the print data is below a prescribed threshold value, while a satisfactory printing state signifies that the ratio is greater than or equal to the prescribed threshold value. The threshold value in the embodiment is 90%. However, this value can be adjusted to suit the type of paper, ink, or the like.

Specifically, in S18 the CPU 65 compares the printed state for the line detected by the photosensor 50 with the print data for the same line. In S20 the CPU 65 determines based on the results of the comparison whether 90% or more of the areas to be printed based on the print data were actually detected on the recording paper P. If 90% or greater of the print data was detected (S20: YES), then the printing state for the initial line worth of print data is found satisfactory. In this case, in S22 the CPU 65 drives the linefeed motor 71 in the forward direction for conveying the recording paper P in the conveying direction B until the recording paper P is returned to a position advanced one line worth past the original position of the recording paper P before the recording paper P was conveyed in reverse for the printing state detection process. Therefore, the region on the recording paper P for printing the next line after the initially printed line is moved to the printing position of the recording head 39 at this time.

In S24 the CPU 65 drives the recording head 39, linefeed motor 71, and carriage motor 73 to execute a printing operation based on the remaining print data, and subsequently ends the process. Hence, when the printing state of the initial line worth is found satisfactory, the CPU 65 executes the remaining printing operation based on the print data stored in the image memory 37 without interruption, and subsequently ends the process. Accordingly, the user can obtain the desired printing results.

However, if less than 90% of the print data was detected (S20: NO), then the printed state of the initial line is determined to be unsatisfactory. In this case, the CPU 65 reads the printing problem detection number from the EEPROM 68 and determines in S26 whether this printing problem is the first detected since the print data was initially stored in the image memory 37, i.e., since the start of the printing process of FIG. 7. If the printing problem detection number is zero(0) indicating that this printing problem is the first detected since the start of the printing process (S26: YES), then in S32 the CPU 65 increments the printing problem detection number by one in the EEPROM 68 and controls the linefeed motor 71 to drive the purging device 48 for performing a purge process. The purge process functions to draw ink out of the nozzles 53*a* and the like in the recording head 39 in order to restore the printing state when printing problems are caused by obstructed nozzles or the like.

In S34 the CPU 65 drives the linefeed motor 71 to rotate in the forward direction, causing the conveying roller 60 to rotate in the direction for conveying the recording paper P in the conveying direction B until the recording paper P is returned to a position advanced one line worth past the original position of the recording paper P before the recording paper P was backed up. In other words, the region of the recording paper P for printing the next line of print data after the initially printed line is conveyed to the printing position of the recording head 39.

Subsequently, the CPU 65 returns to S12 and executes the process described above from S12 to S20. It is noted that at this time, in S12, the second line's worth of print data is printed on the paper at the corresponding position. If the purge process executed in S32 has successfully restored the printing state of the printing device 1 so that the printing state is found satisfactory (S20: YES), then in S22 the CPU 65 conveys the recording paper P the prescribed amount in the conveying direction B and in S24 executes a printing operation based on the remaining print data. Subsequently, the CPU 65 ends the printing process.

However, if the purge process executed in S32 was not successful in restoring the printing state and the printing state is found to be unsatisfactory (S20: NO), then, since the printing problem detection number is now one indicating that the printing state was found to be unsatisfactory twice since print data was first inputted in the image memory 37 (S26: NO), in S28 the CPU 65 displays an out-of-ink warning on the control panel 4 urging the user to replace the ink tank 40. In S30 the CPU 65 determines whether the ink tank 40 in question has been replaced and loops back to S30 as long as the ink tank 40 has not been replaced (S30: NO). When the ink tank 40 has been replaced (S30: YES), in S32 the CPU 65 initializes the printing problem detection number to zero(0) and performs the purge process. The purge process serves to supply ink from the newly installed ink tank 40 to the recording head 39 so that printing can be performed satisfactorily in the next printing process.

Hence, if the printing state is not restored (no in S20) by executing the purge process in S32 as described above, the user is prompted to replace the ink tank in question in S28. This method is not only convenient for the user, but reduces the frequency in which the user is prompted to replace ink tanks irrespective of whether the ink tank still holds sufficient ink.

In S34 the CPU 65 drives the linefeed motor 71 to rotate in the forward direction, rotating the conveying roller 60 in the direction for conveying the recording paper P in the conveying direction B until the recording paper P is advanced a line worth farther than the original position prior to conveying the recording paper P in reverse. The CPU 65 subsequently returns to S12 and repeats the process from S12 to S20. Hence, the operations for conveying the recording paper P to the printing position (S34), executing a printing operation based on a line worth of print data (S12), conveying the recording paper P in reverse (S14), and detecting the printing state in the line of printed data (S16) are repeated until the printing state is restored and found to be satisfactory (S20: YES). In this way, the printing device 1 according to the embodiment can reliably restore the printed state.

It is noted that the printing problem detection number is initialized to zero(0) when the printing process is started and also when the ink tank 40 is replaced (yes in S30). So, the printing problem detection number becomes either zero(0) or one. After the ink tank 40 is replaced (yes in S30), if the printing state is still unsatisfactory (no in S20) and the printing problem detection number is zero(0) in S26 (yes in S26), it is known that the printing state is found to be unsatisfactory once since the ink tank was replaced. In such a case, the purging process of S32 is executed similarly to the case where the printing state is found to be unsatisfactory once since the printing process was started. Similarly, after the ink tank 40 is replaced (yes in S30), if the printing state is still unsatisfactory (no in S20) and the printing problem detection number is one in S26 (no in S26), it is known that the printing state is found to be unsatisfactory twice since the ink tank was replaced in S30. In such a case, the warning process of S28 is executed similarly to the case where the printing state is found to be unsatisfactory twice since the printing process was started.

When print data is inputted into the printing device 1 according to the embodiment, the printing device 1 detects the printing state in a region of the recording paper P printed based on a line worth of the inputted print data. Hence, the printing device 1 according to the embodiment suppresses the needless consumption of the recording paper P, ink, and other consumables that occurs when performing test prints simply to detect the printing state.

Further, since the printing state is detected with the photosensor 50 disposed upstream of the printing position of the recording head 39 with respect to the conveying direction B for detecting the left and right edges of the recording paper P, a separate sensor is not required for detecting the printing state, thereby achieving an inexpensive printing device 1.

While the invention has been described in detail with reference to the embodiment thereof, it would be apparent to those skilled in the art that various changes and is modifications may be made therein without departing from the spirit of the invention.

For example, the printing state is restored in the embodiment by executing a purge process and a process to display an out-of-ink warning on the control panel 4. However, it is also possible simply to perform a process for displaying an out-of-ink warning on the control panel 4, without executing the purge process. That is, the process of S26 and S32 may be omitted. Further, the process for restoring the printing state is not limited to the purge process and the out-of-ink warning display process. For example, the printing device 1 may be configured to execute a flushing process in which ink is expelled through the nozzles 53*a* to restore the ink ejection state. Further, the user can be warned that the printing device 1 is out of ink by lighting a lamp on the printing device 1 or outputting a warning sound.

Further, while the printing state is detected each time print data is inputted into the printing device 1 in the embodiment described above, the timing at which the printing state is detected is not limited to this timing. For example, the printing device 1 may be configured to detect the printing state when print data is first inputted after a prescribed time has elapsed since the previous printing operation or the first time print data is inputted after replacing an ink tank.

Further, while the photosensor 50 detects a printed region for one line worth in the embodiment and the printing device 1 determines whether the printing state is satisfactory based on the detection results, the photosensor 50 need not detect the entire printed region of the line. For example, the photosensor 50 may detect the printing state of a prescribed region within one line worth of printed data, while the printing device 1 determines whether the printing state is satisfactory based on the detection results, thereby requiring less time for performing the detection operation than when performing detection of the entire line.

Further, in the embodiment described above, the process for restoring the printing state is repeated until the printing state is restored and determined to be satisfactory. However, the process may forcibly end in a printing error if the printing state is not satisfactory following replacement of the ink tank because there is a possibility that the poor printing state is due to a completely different factor than lack of ink in the ink tanks or obstructed nozzles.

Further, while the printing state is detected in printing performed based on the initial line worth of print data in the embodiment, the printing device 1 may be configured to detect the printing state from an image printed in the middle of the printing operation or based on the last line of print data, for example.

The printing device in the embodiment described above is configured as an inkjet printer that ejects ink through the nozzles 53*a*. However, the inkjet printer may be modified to a thermal printer that performs printing by heating with a thermal head.

What is claimed is:

1. A printing device comprising:

a conveying unit conveying a recording medium in a conveying direction to a prescribed printing position;

a printing unit configured to print an image based on inputted print data on the recording medium conveyed to the printing position by the conveying unit;

a detecting unit configured to detect the recording medium on an upstream side of the printing position of the printing unit with respect to the conveying direction;

a partial printing unit controlling the printing unit to execute a printing operation based on a part of the inputted print data that is less than the entirety of the inputted print data, when print data is inputted;

a reverse conveying unit conveying the recording medium in an opposite direction to the conveying direction so that a printing region printed by the partial printing unit is in a detection position at which the detecting unit is configured to detect at least part of the printing region;

a printing state detecting unit controlling the detecting unit to detect a printing state in the printing region conveyed to the detection position of the detecting unit by the reverse conveying unit; and a restoration process executing unit executing a process to restore the printing state when the printing state detecting unit detects that the printing state in the printing region is unsatisfactory, a satisfactory printing state conveying unit conveying the recording medium in the conveying direction, after the recording medium has been conveyed in the opposite direction by the reverse conveying unit, to a position downstream in the conveying direction of an original position of the recording medium before the recording medium was conveyed in reverse, when the printing state detecting unit detects that the printing state in the printing region is satisfactory; and a remainder printing unit controlling the printing unit to execute a printing operation on the recording medium based on a remaining part of the inputted print data that is not printed by the partial printing unit, when the satisfactory printing state conveying unit has conveyed the recording medium in the conveying direction downstream of the original position before the recording medium was conveyed in reverse.

2. A printing device according to claim 1, further comprising:

a post-restoration conveying unit conveying the recording medium in the conveying direction, after the recording medium has been conveyed in the opposite direction by the reverse conveying unit, to a position downstream in the conveying direction of the original position of the recording medium before the recording medium was conveyed in reverse, after the restoration process executing unit has executed the process to restore the printing state; and a repeating unit repeating operations in which the post-restoration conveying unit conveys the recording medium downstream in the conveying direction, the partial printing unit controls the printing unit to execute a printing operation based on a part of the inputted print data, the reverse conveying unit conveys the recording medium, and the printing state detecting unit controls the detecting unit to detect the printing state, the repeating unit repeating the operations until the printing state detecting unit detects that the printing state in the printing region is satisfactory.

3. A printing device according to claim 1, wherein the printing unit comprises:

a print head configured to execute printing operations on the recording medium by ejecting ink from ink ejection holes;

an ink tank holding ink that is supplied to the print head; and a restoring unit drawing in or expelling ink through the ink ejection holes of the print head to restore the ink ejection state; and the restoration process executing unit performs at least one of a process of controlling the restoring unit to restore the ink ejection state and a process of outputting data prompting a user to replace the ink tank.

4. A printing device according to claim 3, wherein the restoration process executing unit performs the process of controlling the restoring unit to restore the ink ejection state as a first process for restoring the printing state after print data has been initially inputted, and executes the process to output data prompting the user to replace the ink tanks as a second process for restoring the printing state after print data has been initially inputted.

5. A printing device according to claim 3, further comprising:

a carriage supporting the print head and the detecting unit and configured to reciprocate in a main scanning direction orthogonal to the conveying direction; and an edge detecting unit performing an edge detection before the partial printing unit controls the printing unit to perform the printing operation based on the part of the inputted print data, the edge detecting unit performing the edge detection by controlling the detecting unit to detect edges of the recording medium with respect to the main scanning direction, while reciprocating the carriage and the detecting unit supported on the carriage in the main scanning direction.

6. A printing device according to claim 1, wherein the inputted print data is not a predetermined test pattern.

7. A printing device according to claim 6, wherein the inputted print data is received in an image memory of the printing device from an external source, wherein the inputted print data received in the image memory has been:

inputted from an external device that is connected by a cable, scanned by a scanning unit when the printing device performs a copy function for printing data scanned by the scanning unit, or read from a memory card when the printing device performs a function for directly printing data stored on the memory card without the use of a personal computer.

8. A printing device, comprising:

a conveying unit, including a linefeed motor, wherein the conveying unit is configured to convey a recording medium in either a conveying direction or a direction opposite to the conveying direction;

a printing unit, including a recording head, wherein the printing unit is configured to print an image based on inputted print data on the recording medium conveyed to a prescribed printing position by the conveying unit;

a detecting unit configured to detect a printing state of an image on the recording medium at an upstream side of the printing position with respect to the conveying direction;

a controller which controls the conveying unit, the printing unit, and the detecting unit, wherein the controller controls the conveying unit, the printing unit, and the detecting unit to execute a process wherein the linefeed motor conveys the recording medium to the printing position, the recording head performs a printing operation of a first line of the print data, wherein the first line of print data is only a part of the inputted print data, the conveying unit conveys the recording medium in a direction opposite to the conveying direction so that the first line of the print data is in a detection position at which the detecting unit is configured to detect a printing state of the first line of the print data;

the controller configured to execute a printing operation on the recording medium wherein a remaining part of the inputted print data is printed, when the detecting unit detects that the printing state of the first line of print data is satisfactory, and the controller configured to control the printing device to perform a purge process or indicate a warning, when the detecting unit detects that the printing state of the first line of print data is unsatisfactory.

9. A printing device according to claim 8, wherein if the first line of print data is unsatisfactory and the printing device performs a purge process, subsequent to the purge process, the controller controls the conveying unit, the printing unit, and the detecting unit to execute a process wherein the recording head performs a printing operation of a second line of the print data, the conveying unit conveys the recording medium in a direction opposite to the conveying direction so that the second line of the print data is in the detection position at which the detecting unit can detect a printing state of the second line of the print data;

the controller configured to execute a printing operation on the recording medium wherein a remaining part of the inputted print data is printed, when the detecting unit detects that the printing state of the second line of print data is satisfactory, and the controller configured to control the printing device to indicate a warning, when the detecting unit detects that the printing state of the second line of print data is unsatisfactory.

10. A printing device according to claim 9, wherein the detecting unit includes a photosensor positioned upstream of the printing position of the recording head with respect to the conveying direction.

* * * * *